US011255335B2

(12) United States Patent
Pirouzpanah et al.

(10) Patent No.: US 11,255,335 B2
(45) Date of Patent: Feb. 22, 2022

(54) BLOWER ASSEMBLY FOR USE IN AN AIR HANDLING SYSTEM AND METHOD FOR ASSEMBLING THE SAME

(71) Applicant: REGAL BELOIT AMERICA, INC., Beloit, WI (US)

(72) Inventors: Sahand Pirouzpanah, Miamisburg, OH (US); Joseph A. Henry, Dayton, OH (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 219 days.

(21) Appl. No.: 15/812,426

(22) Filed: Nov. 14, 2017

(65) Prior Publication Data

US 2019/0145657 A1 May 16, 2019

(51) Int. Cl.

| | |
|---|---|
| ***F04D 25/06*** | (2006.01) |
| ***F04D 29/52*** | (2006.01) |
| ***F04D 29/64*** | (2006.01) |
| ***F04D 29/32*** | (2006.01) |
| ***F04D 29/54*** | (2006.01) |
| ***F24H 3/02*** | (2006.01) |
| ***F04D 29/42*** | (2006.01) |
| ***F04D 17/06*** | (2006.01) |
| ***F04D 29/58*** | (2006.01) |
| *F04D 25/08* | (2006.01) |

(52) U.S. Cl.

CPC ..... *F04D 25/0606* (2013.01); *F04D 17/06* (2013.01); *F04D 25/0653* (2013.01); *F04D 29/329* (2013.01); *F04D 29/4253* (2013.01); *F04D 29/526* (2013.01); *F04D 29/547* (2013.01); *F04D 29/5806* (2013.01); *F04D 29/644* (2013.01); *F24H 3/02* (2013.01); *F04D 25/082* (2013.01); *F04D 29/522* (2013.01)

(58) Field of Classification Search

CPC .. F04D 17/06; F04D 25/0653; F04D 29/4253; F04D 29/5813; F04D 29/62; F04D 25/064; F24H 3/02; F24H 9/0063; F24H 9/0073

USPC ..... 122/1 A; 165/8, 4, 10

See application file for complete search history.

(56) References Cited

U.S. PATENT DOCUMENTS

| | | | | |
|---|---|---|---|---|
| 3,668,887 | A * | 6/1972 | Riello | F24F 1/02 62/262 |
| 5,350,281 | A * | 9/1994 | Hagshenas | F04D 25/082 415/144 |
| 7,044,851 | B2 | 5/2006 | Peterson et al. | |
| 7,381,028 | B2 | 6/2008 | Hancock et al. | |
| 7,855,882 | B2 * | 12/2010 | Franz | F04D 25/0613 361/679.48 |
| 8,587,165 | B2 * | 11/2013 | Zahora | F04D 25/082 310/67 R |
| 8,948,576 | B2 | 2/2015 | Logan et al. | |

(Continued)

*Primary Examiner* — Nathan C Zollinger
*Assistant Examiner* — Timothy P Solak
(74) *Attorney, Agent, or Firm* — Armstrong Teasdale LLP

(57) ABSTRACT

A blower assembly includes a housing including an inner shell and an outer shell that define a flow passage therebetween. The inner shell also at least partially defines a cavity. The blower assembly also includes a fan coupled within the housing such that the fan also at least partially defines the cavity. The blower assembly further includes a motor configured to rotate about an axis. The motor is coupled to the inner shell and is positioned within the cavity radially inward of the flow passage.

20 Claims, 4 Drawing Sheets

(56) References Cited

U.S. PATENT DOCUMENTS

| | | | | |
|---|---|---|---|---|
| 9,200,847 | B2 * | 12/2015 | Thompson | F27D 7/04 |
| 9,303,882 | B2 | 4/2016 | Hancock | |
| 9,328,939 | B2 | 5/2016 | Edens et al. | |
| 9,696,046 | B2 | 7/2017 | Stewart et al. | |
| 2008/0226454 | A1 * | 9/2008 | Decker | F04D 29/384<br>416/203 |
| 2009/0142203 | A1 * | 6/2009 | De Filippis | H02K 9/06<br>417/353 |
| 2012/0051889 | A1 * | 3/2012 | Gamissans Bou | F04D 17/06<br>415/119 |
| 2012/0138058 | A1 * | 6/2012 | Fu | A61M 16/0066<br>128/204.23 |
| 2014/0023491 | A1 * | 1/2014 | Ruck | F01D 25/28<br>415/183 |
| 2016/0097553 | A1 | 4/2016 | Brian | |
| 2016/0106008 | A1 | 4/2016 | Cotton et al. | |

* cited by examiner

BLOWER ASSEMBLY FOR USE IN AN AIR HANDLING SYSTEM AND METHOD FOR ASSEMBLING THE SAME

BACKGROUND

The field of the disclosure relates generally to air handling systems, and more specifically, to air handling systems that include a compact mixed flow blower assembly positioned between a pair of heat exchangers.

At least some known air handling systems and furnaces include a blower assembly and a plurality of heat exchangers downstream from the blower assembly. In at least some such air handling systems, the heat exchangers are sequentially positioned downstream of the blower assembly such that the airflow is channeled through one heat exchanger after another. Additionally, in at least some known systems, the heat exchangers operate at different temperatures to gradually cause the air being channeled therethrough to increase in temperature. However, after each heat exchanger encountered, the airflow experiences a relatively large pressure drop. In order to maintain the airflow at a desired pressure and velocity, the blower assembly is operated at a higher than desired rotating speeds. In at least some known blower assemblies, operating at a higher than desired rotating speeds causes a decrease in the aerodynamics efficiency of the entire system and an increase in the noise level generated by the blower assembly, which is undesirable.

Furthermore, at least some known blower assemblies used in air handling systems include a mixed flow fan for channeling air through the air handling system. At least some known mixed flow fans include an externally mounted motor and occupy a relatively large amount of space within the air handling system. Additionally, in order to channel air through the air handling system at a desired rate, at least some known mixed flow fans operate at a relatively high speed, which may generate undesirable noise.

BRIEF DESCRIPTION

In one aspect, a blower assembly is provided. The blower assembly includes a housing including an inner shell and an outer shell that define a flow passage therebetween. The inner shell also at least partially defines a cavity. The blower assembly also includes a fan coupled within the housing such that the fan also at least partially defines the cavity. The blower assembly further includes a motor configured to rotate about an axis. The motor is coupled to the inner shell and is positioned within the cavity radially inward of the flow passage.

In another aspect, an air handling system configured to channel an airflow therethrough is provided. The air handling system includes a cabinet, a duct coupled in flow communication with the cabinet, and a blower assembly coupled within the cabinet. The blower assembly includes a housing including an inner shell and an outer shell that define a flow passage therebetween, wherein the inner shell at least partially defines a cavity. The blower assembly also includes a fan coupled within the housing such that the fan at least partially defines the cavity and a motor configured to rotate about an axis. The motor is coupled to the inner shell and is positioned within the cavity radially inward of the flow passage.

In yet another aspect, a method for assembling a blower assembly is provided. The method includes coupling an inner shell of a housing to an outer shell of the housing to define a flow passage therebetween, wherein the inner shell at least partially defines a cavity. The method also includes coupling a fan within the outer shell such that the fan partially defines the cavity and coupling a motor to the inner shell and to the fan such that the motor is positioned within the cavity radially inward of the flow passage.

Although specific features of various embodiments may be shown in some drawings and not in others, this is for convenience only. Any feature of any drawing may be referenced and/or claimed in combination with any feature of any other drawing.

DETAILED DESCRIPTION

The apparatus and method herein describe an air handling system that includes a compact mixed flow blower assembly coupled within a cabinet. The system also includes a heat exchanger positioned upstream of the blower assembly to preheat the air entering the blower assembly and another heat exchanger positioned downstream of the blower assembly to further increase the temperature of the airflow being channeled therethrough. The blower assembly is a compact design that includes a housing that defines a central cavity that houses the motor therein. The housing also defines a ring-shaped flow passage that extends circumferentially around the motor. Such a configuration results in a physically smaller blower assembly than that as is currently known.

Additionally, by positioning a heat exchanger upstream of the blower assembly to preheat the airflow, the blower assembly channels the air through larger effective area of the heat exchanger upstream of the blower assembly. As such, the airflow is subject to a reduced pressure drop, which increases the aerodynamics efficiency of the air handling system. Furthermore, the reduced pressure drop and improved velocity retention enable the fan within the blower assembly to rotate at a slower speed than if the blower assembly were pushing the airflow through multiple heat exchangers downstream of the blower assembly. The slower operational speed of the blower assembly generates less noise than operation at higher speeds.

Figure 1:
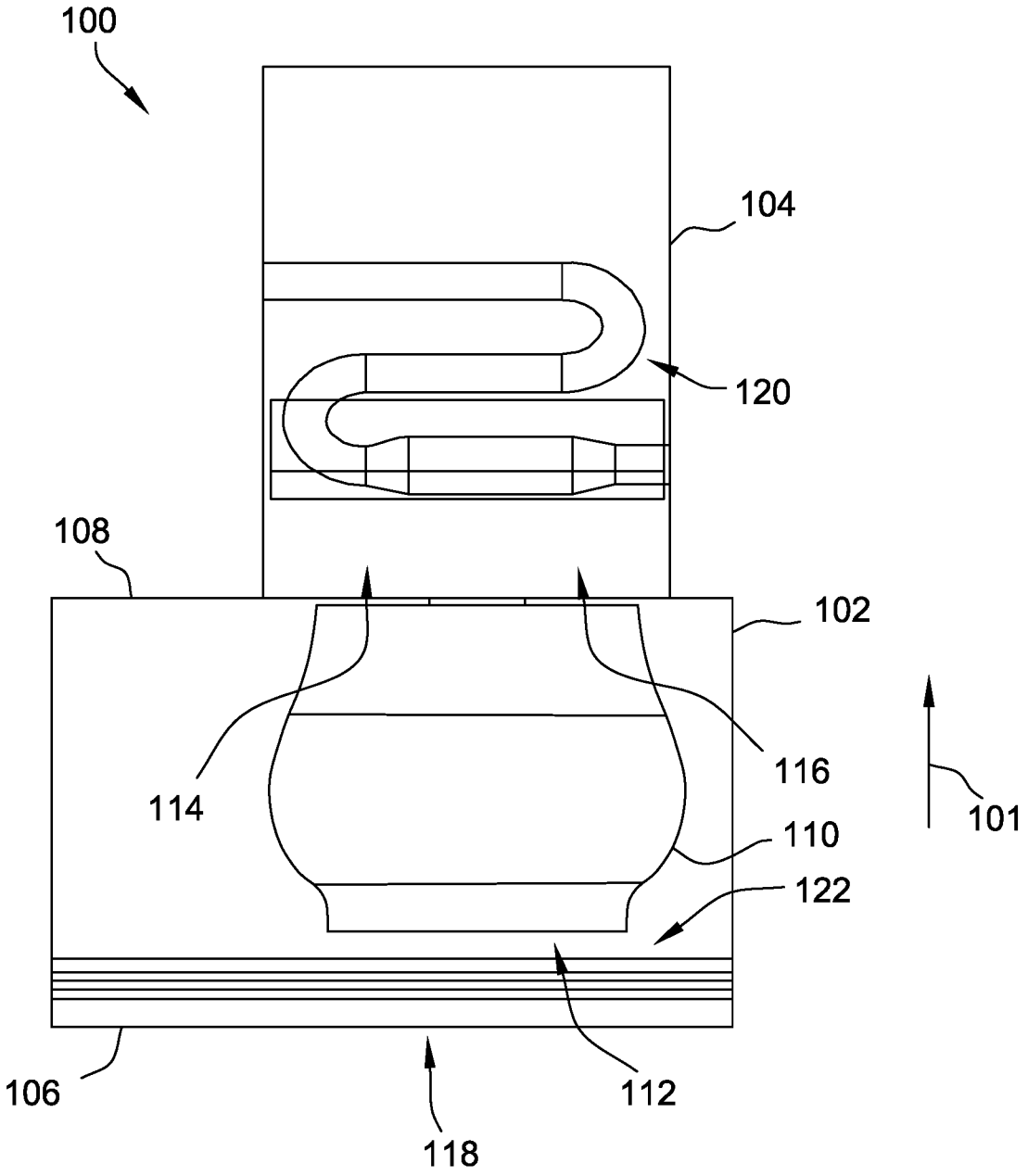
FIG. 1 is a schematic view of an exemplary air handling system.

FIG. 1 is a schematic view of an exemplary air handling system 100, such as a furnace assembly, for channeling an airflow therethrough in the direction of arrow 101. In the exemplary embodiment, air handling system 100 includes a cabinet 102 and a casing 104 coupled in flow communication with cabinet 102. More specifically, casing 104 is coupled to cabinet 102 such that casing 104 is positioned upstream from cabinet 102 with respect to the airflow being channeled through system 100. Cabinet 102 includes a first side 106 and an opposing second side 108 that at least partially define a cavity therebetween. Air handling system 100 includes a blower assembly 110 coupled to cabinet 102 such that blower assembly 110 is positioned within the cavity of cabinet 102.

In the exemplary embodiment, blower assembly 110 includes a blower inlet 112 and a blower outlet 114. More specifically, blower inlet 112 is positioned within the cavity of cabinet 102 and blower outlet 114 is substantially aligned with an outlet 116 of cabinet 102 defined in second side 108. Cabinet 102 also includes a cabinet inlet 118 defined in first side 106 such that cabinet inlet 118 and cabinet outlet 116 are positioned opposite from one another in cabinet 102.

In the exemplary embodiment, air handling system 100 also includes a primary heat exchanger 120 and secondary heat exchanger 122 configured to increase the temperature of the airflow being channeled through air handling system 100. More specifically, primary heat exchanger 120 is coupled within casing 104 and positioned downstream of blower outlet 114 of blower assembly 110 with respect the airflow direction 101 through system 100. As such, the airflow being channeled into primary heat exchanger 120 has already passed through blower assembly 110 and is moving at a higher velocity and pressure than the airflow upstream of blower assembly 110. In the exemplary embodiment, secondary heat exchanger 122 is positioned upstream of blower inlet 112 of blower assembly 110 such that the airflow is channeled sequentially through secondary heat exchanger 122, blower assembly 110, and primary heat exchanger 120. More specifically, both blower assembly 110 and secondary heat exchanger 122 are coupled within cabinet 102 such that secondary heat exchanger 122 is positioned between cabinet inlet 118 and blower inlet 112.

Although FIG. 1 illustrates secondary heat exchanger 122 positioned entirely within cabinet 102, it is contemplated that secondary heat exchanger 122 may be separated into two portions with the first portion being positioned in the location of secondary heat exchanger 122 in FIG. 1 and the second portion being positioned in downstream of blower assembly 100 and upstream of primary heat exchanger 120.

In operation, the airflow enters cabinet 102 through cabinet inlet 118 and is then is channeled through or proximate secondary heat exchanger 122 to increase the temperature of the airflow. After secondary heat exchanger 122, the airflow flows through blower inlet 112 where a fan (not pictured) rotates to bring the airflow through inlets 118 and 112. Within blower assembly 110, the speed and pressure are increased and the airflow is discharged through aligned blower outlet 114 and cabinet outlet 116 into casing. Casing 104, the airflow is channeled through primary heat exchanger 120 to further increase the temperature of the airflow before being channeled further downstream in air handling system 100.

Accordingly, the airflow is heated initially by secondary heat exchanger 122 upstream of blower assembly 110 and again by primary heat exchanger 120 downstream of blower assembly 110. In such a configuration, the airflow within casing 104 is less tortuous because the airflow is channeled though only one heat exchanger. As such, the airflow is subject to a reduced pressure drop, which increases the efficiency of air handling system 100. Additionally, the reduced pressure drop and improved velocity retention enable the fan within blower assembly 110 to rotate at a slower speed than if blower assembly 110 were pushing the airflow through multiple heat exchangers downstream of blower assembly 110. The slower operational speed of blower assembly 110 generates less noise than operation at higher speeds.

Figure 2:
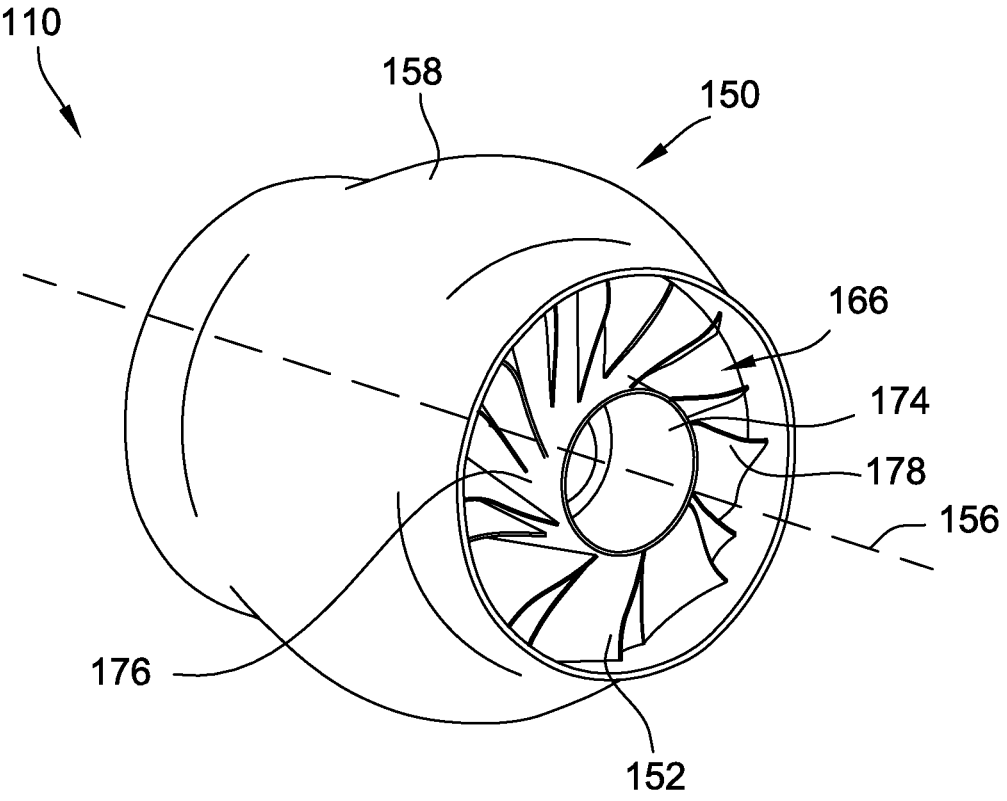
FIG. 2 is front perspective view of an exemplary blower assembly that may be used with the air handling system shown in FIG. 1.
Figure 3:
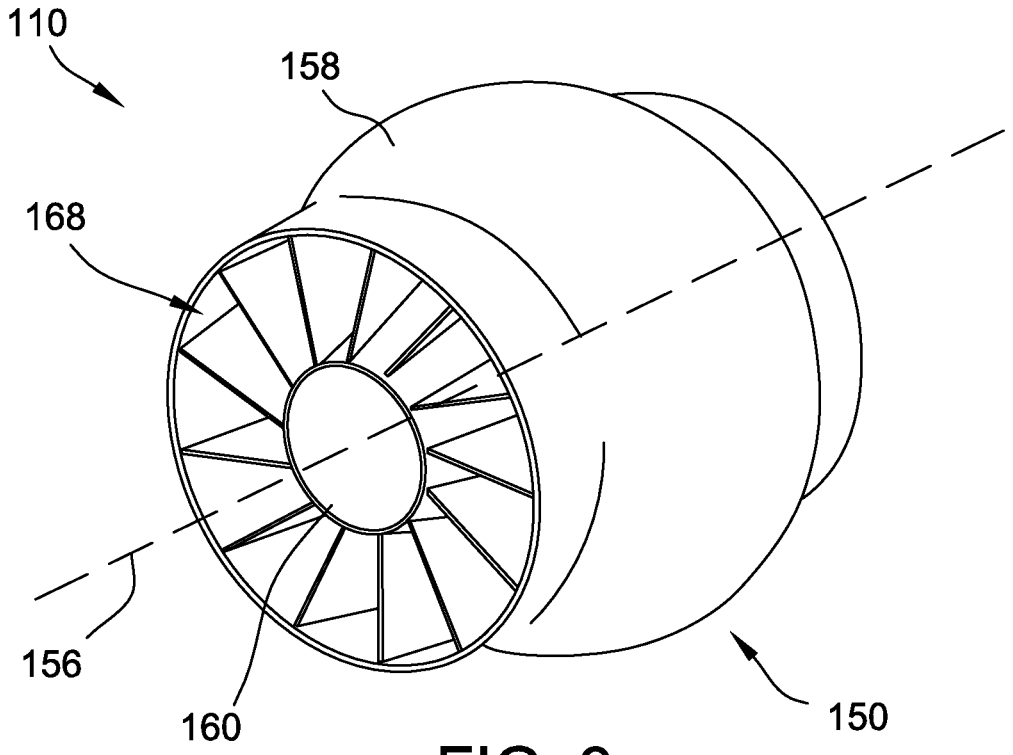
FIG. 3 is a rear perspective view of the blower assembly shown in FIG. 2.
Figure 4:
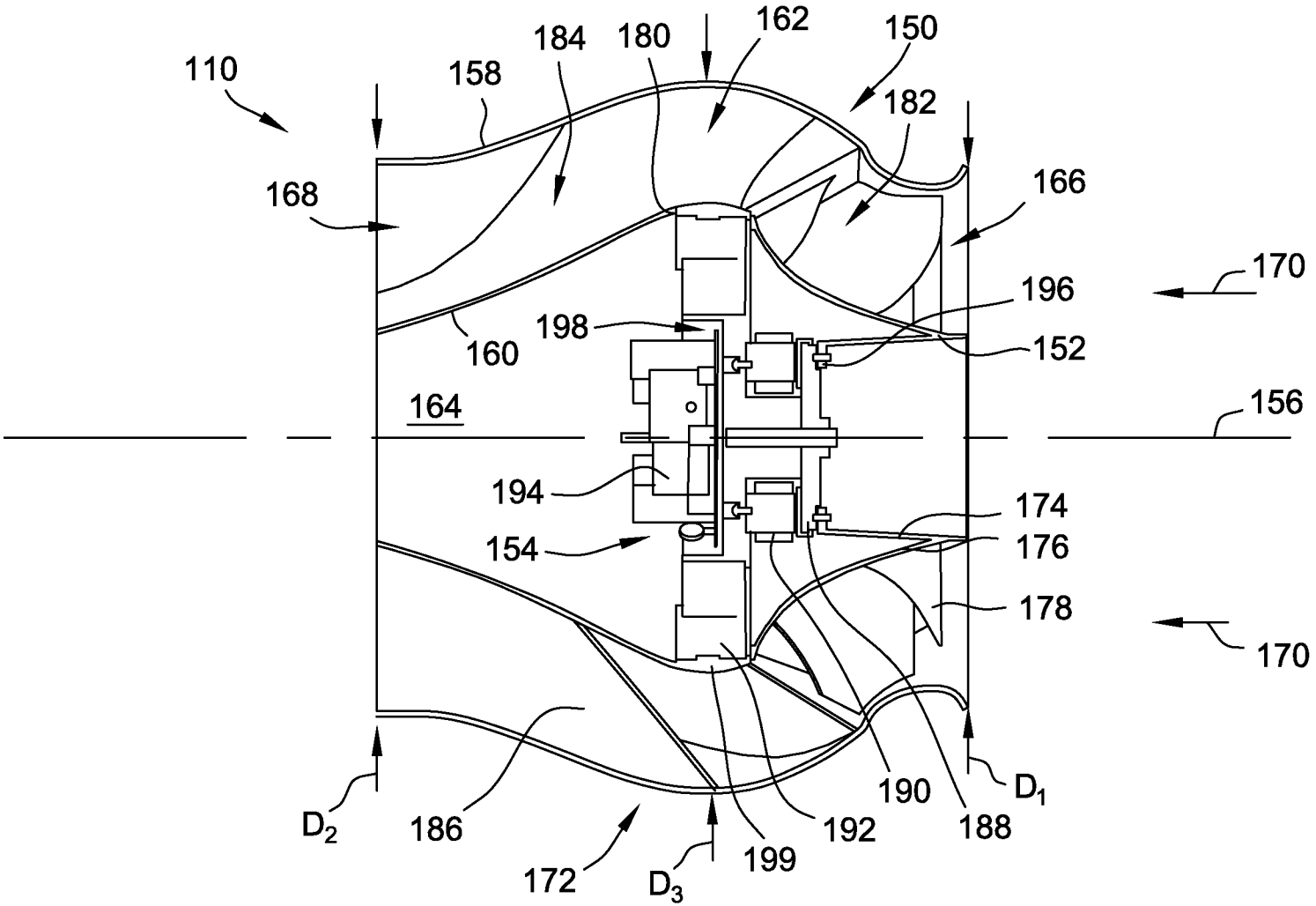
FIG. 4 is a cross-sectional view of the blower assembly shown in FIG. 2.

FIG. 2 is front perspective view of blower assembly 110, FIG. 3 is a rear perspective view of blower assembly 110, and FIG. 4 is a cross-sectional view of blower assembly 110. In the exemplary embodiment, blower assembly 110 includes a housing 150, a fan 152 coupled within housing 150, and a motor 154 coupled to housing 150 and to fan 152 such that rotation of motor 154 causes rotation of fan about a common axis 156. As best shown in FIG. 4, housing includes an outer shell 158 and an inner shell 160 that are spaced apart to define a flow passage 162 therebetween. Furthermore, inner shell 160 at least partially defines an interior cavity 164 within housing 150. Outer shell 158 defines an inlet 166 of housing 150 and outer shell 158 and inner shell 160 combine to define a ring-shaped outlet 168 of housing 150 positioned downstream from inlet 166 in a direction 170 of an airflow flowing through blower assembly 110. In the exemplary embodiment, inlet 166 includes a first diameter D1, outlet 168 includes a second diameter D2, and a central portion 172 of housing 150 includes a third diameter D3 that is larger than first diameter D1 and second diameter D2. More specifically, outer shell 158 and inner shell 160 of housing 150 are curved between inlet 166 and outlet 168 such that central portion 172 bulges radially outward.

In the exemplary embodiment, fan 152 includes an inner cylinder 174, a curved plate 176 coupled to inner cylinder 174, and a plurality of blades 178 extending radially outward from plate 176. As best shown in FIG. 4, fan 152 is positioned within inlet 166 of housing 150 upstream of inner shell 160. More specifically, inner shell 160 includes a first end 180 and fan in coupled within housing 150 upstream of first end 180. In such a configuration, fan plate 176 and outer shell 158 define an upstream portion 182 of flow passage 162 therebetween and inner shell 160 and outer shell 158 define a downstream portion 184 of flow passage 162. Blades 178 extend from plate 176 into upstream portion 182 to channel the airflow from upstream portion 182 into downstream portion 184. Housing 150 includes a plurality of vanes 186 extending between outer shell 158 and inner shell 160 within downstream portion 184 to guide the airflow through housing 150 in an efficient manner.

As shown in FIG. 4, fan 152 is positioned within inlet 166 of housing 150 and also partially defines cavity 164. In the exemplary embodiment, motor 154 is coupled to both inner shell 160 and to fan 152 such that motor 154 is positioned within cavity 164 radially inward of flow passage 162. In such a configuration, ring-shaped flow passage 162 extends circumferentially about motor 154. More specifically, motor 154 is substantially axially aligned with central portion 172 of housing 150 such that motor 154 is positioned axially between fan 152 and inner shell 160.

In the exemplary embodiment, motor 154 includes a rotor 188 coupled to fan 152, a stator 190 spaced from rotor 188, a heat exchange member 192 coupled to stator 190, and a controller 194 coupled to heat exchange member 192. Specifically, rotor 188 is directly coupled to fan 152. More specifically, rotor 188 is directly coupled to a flange 196 that extends radially inward from a downstream end of inner cylinder 174 of fan 154. Heat exchange member 192 defines a cavity 198 in which controller 194 is coupled. As best shown in FIG. 4, heat exchange member 192 extends radially outward such that a portion of heat exchange member 192 is at least partially exposed to the airflow within flow passage 162. More specifically, heat exchange member 192 includes a plurality of heat fins 199, at least one of which is at least partially exposed to the airflow within flow passage 162.

In operation, controller 194 controls the flow of power into stator 190, which causes rotor 188 to rotate about axis 156. Because rotor 188 is directly coupled to inner cylinder 174, when rotor 188 rotates, fan 152 also rotates. Rotation of fan 152 draws air into housing 150 though inlet 166. More specifically, fan 154 draws air into upstream portion 182 of flow passage 162. As the air passes through blades 178 of fan 152, its pressure and velocity increase as it is discharged from fan 152 into downstream portion 184 of flow passage 162 between outer shell 158 and inner shell 160. Vanes 186 guide the airflow through downstream portion 184 until the airflow is exhausted through outlet 168. In the exemplary embodiment, as the airflow passes through flow passage 162, the airflow passes over heat fins 199 of heat exchange member 192. In operation, the electrical components that make up controller 194 increase in temperature and produce heat, which is absorbed by heat exchange member 192. In the exemplary embodiment, the airflow is cooling airflow and is at a lower temperature than motor 154 and heat exchange member 192. As the airflow passes over heat fins 199 in flow passage 162, the airflow absorbs heat from fins 199 and decreases the temperature of heat exchange member 192, thereby keeping the environment around motor 154 sufficiently cool for operation.

Figure 5:
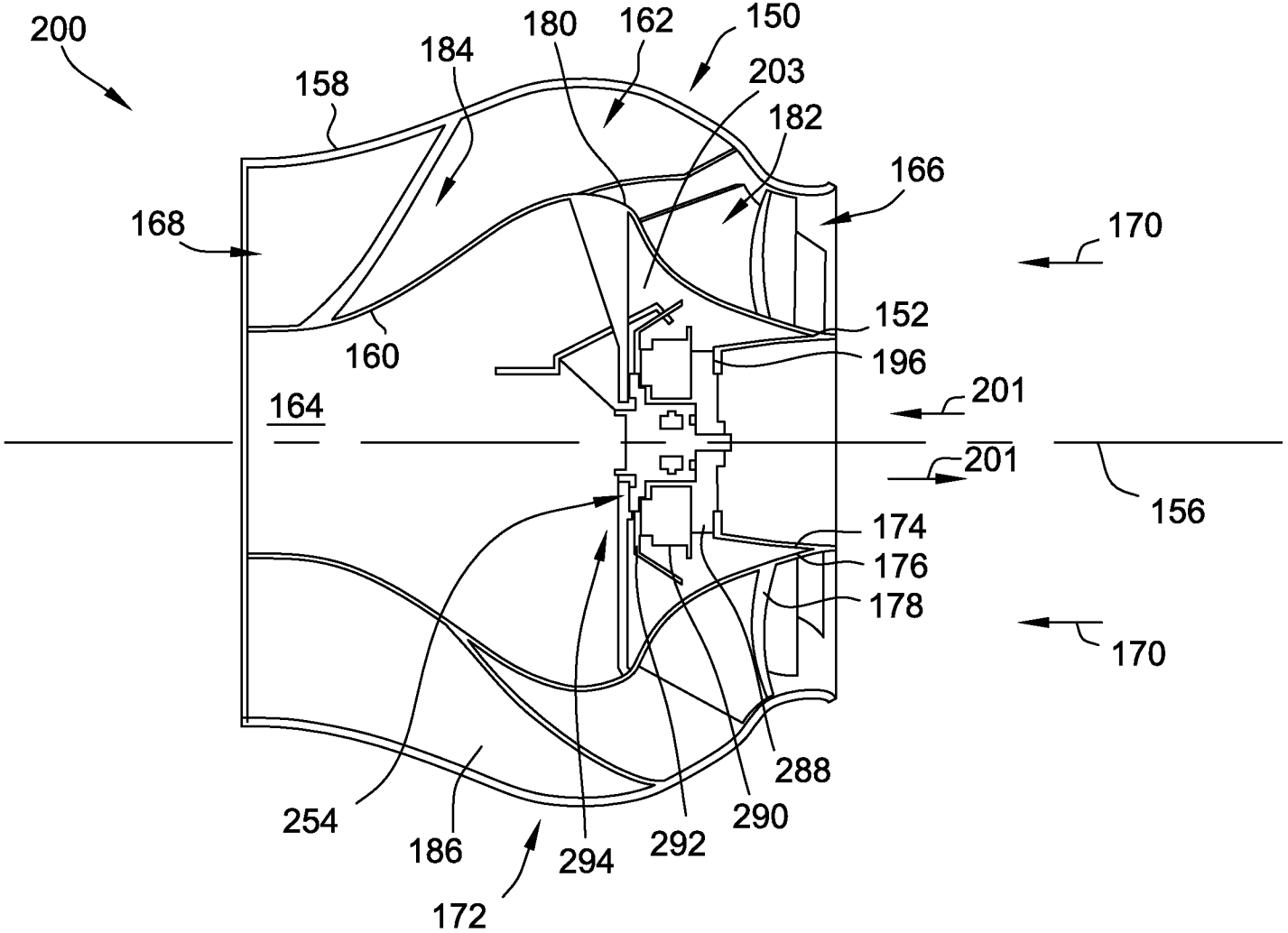
FIG. 5 is a cross-sectional view of another blower assembly that may be used with the air handling system shown in FIG. 1.

FIG. 5 illustrates an alternative embodiment of blower assembly 200 for use in air handling system 100 (shown in FIG. 1). Blower assembly 200 is substantially similar to blower assembly 100 (shown in FIG. 4) in operation and composition, with the exception that blower assembly 200 includes a motor 254 that is isolated from the flow passage, rather than motor 154 with heat fins 199 exposed to the airflow in flow passage 162 (all shown in FIG. 4). As such, components shown in FIG. 5 are labeled with the same reference numbers used in FIG. 4. Motor 254 may be substituted for motor 154 within air handling system 100 when air handling system 100 is used to channel a high temperature airflow.

As described herein, housing 150 and fan 154 of blower assembly 200 are substantially similar as in blower assembly 110. Motor 254, however, has a slightly different configuration than motor 154. Motor 254 includes a rotor 288 directly coupled to flange 196 of fan 152, a stator 190 spaced from rotor 288, a housing member 292 coupled to stator 290, and a controller 294 coupled to housing member 292 and stator 290. As shown in FIG. 5, rotor 288, stator 292, and housing member 292 are all positioned radially inward of fan plate 176. More specifically, rotor 288, stator 292, and housing member 292 are all positioned within the portion of cavity 164 defined by fan plate 176. As such, motor 254 is isolated from flow passage 162 and is not exposed to the high temperature airflow flowing through housing 150.

In one embodiment of blower assembly 200, a secondary airflow 201 is used to provide cooling to motor 254. More specifically, cooling secondary airflow 201 is channeled into inner cylinder 174 of fan 152 to cool at least rotor 288, stator 290, and housing member 292. In another embodiment of blower assembly 200, an insulation member 203 encloses motor 288 to prevent motor 254 from exposure to high temperature airflow within flow passage 162. When blower assembly 200 is used in the configuration shown and described in FIG. 1, noise reduction and efficiency improvement is achieved by removing motor 254 from primary flow passage 162 and isolating motor 254 from the high temperature airstream coming from secondary heat exchanger 122 located proximate inlet 166.

The apparatus and method herein describe an air handling system that includes a compact mixed flow blower assembly coupled within a cabinet. The system also includes a heat exchanger positioned upstream of the blower assembly to preheat the air entering the blower assembly and another heat exchanger positioned downstream of the blower assembly to further increase the temperature of the airflow being channeled therethrough. The blower assembly is a compact design that includes a housing that defines a central cavity that houses the motor therein. The housing also defines a ring-shaped flow passage that extends circumferentially around the motor. Such a configuration results in a physically smaller blower assembly than that as is currently known.

Additionally, by positioning a heat exchanger upstream of the blower assembly to preheat the airflow, the blower assembly channels the air through more effective heat exchanger area upstream of the blower assembly. As such, the airflow is subject to a reduced pressure drop, which increases the efficiency of the air handling system. Furthermore, the reduced pressure drop and improved velocity retention enable the fan within the blower assembly to rotate at a slower speed than if the blower assembly were pushing the airflow through multiple heat exchangers downstream of the blower assembly. The slower operational speed of the blower assembly generates less noise than operation at higher speeds.

Exemplary embodiments of an air handling system are described above in detail. The air handling system and its components are not limited to the specific embodiments described herein, but rather, components of the systems may be utilized independently and separately from other components described herein. For example, the blower assembly configuration may also be used in combination with other machine systems, methods, and apparatuses, and are not limited to practice with only the air handling system as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blower assembly comprising:

a housing comprising an inner shell and an outer shell that define an inlet, an outlet, and a flow passage therebetween, wherein said inner shell at least partially defines a cavity;

a fan coupled within said housing, said fan at least partially defining said cavity and comprising a curved plate and an inner arcuate portion, said inner arcuate portion comprising a first end and a second opposed end, said first end coupled to said curved plate at said inlet;

a motor configured to rotate about an axis and coupled to said inner shell, said motor comprising a rotor coupled directly to a flange of said inner arcuate portion, wherein said flange extends radially inward from said second end of said inner arcuate portion, wherein said inner arcuate portion extends axially within said outer shell from said first end at said inlet to said second end at said motor and defines a chamber configured to receive a secondary airflow from said inlet configured to cool said motor, wherein said motor is positioned within said cavity radially inward of said flow passage.

2. The blower assembly in accordance with claim 1, wherein said flow passage extends circumferentially about said motor.

3. The blower assembly in accordance with claim 1, wherein said inlet comprises a first diameter, said outlet comprises a second diameter, and wherein said housing comprises a central portion having a third diameter, wherein said third diameter is larger than said first diameter and said second diameter.

4. The blower assembly in accordance with claim 1, wherein said inner shell and said outer shell are curved between said inlet and said outlet.

5. The blower assembly in accordance with claim 1, wherein said fan comprises a plurality of blades extending from said curved plate into said flow passage.

6. The blower assembly in accordance with claim 5, wherein said curved plate and said outer shell define a first portion of said flow passage therebetween, and wherein said inner shell and said outer shell define a second portion of said flow passage therebetween.

7. The blower assembly in accordance with claim 1, wherein said second end of said inner arcuate portion is positioned axially between said first end and said inner shell.

8. The blower assembly in accordance with claim 1, wherein said motor is isolated from said flow passage.

9. The blower assembly in accordance with claim 1, wherein said motor further comprises a stator axially spaced from said rotor, said rotor being positioned axially between said flange and said stator.

10. The blower assembly in accordance with claim 9, wherein said stator does not extend axially between said rotor and said flange.

11. The blower assembly in accordance with claim 1, wherein said inner arcuate portion extends, at least in part, radially inward from said first end to said second end such that said second end is positioned radially inward from said first end.

12. The blower assembly in accordance with claim 1, wherein said inner arcuate portion further comprises an interior surface that defines said chamber, said interior surface extending circumferentially within said outer shell, and wherein said first end is a free end of said fan that defines a central opening extending radially across the interior surface for directing the secondary airflow into the chamber.

13. An air handling system configured to channel an airflow therethrough, said air handling system comprising:

a cabinet;

a casing coupled in flow communication with said cabinet;

a blower assembly coupled within said cabinet, wherein said blower assembly comprises:

a housing comprising an inner shell and an outer shell that define an inlet, an outlet, and a flow passage therebetween, wherein said inner shell at least partially defines a cavity;

a fan coupled within said housing, said fan at least partially defining said cavity and comprising a curved plate and an inner arcuate portion, said inner arcuate portion comprising a first end and a second opposed end, said first end coupled to said curved plate at said inlet;

a motor configured to rotate about an axis and coupled to said inner shell, said motor comprising a rotor coupled directly to a flange of said inner arcuate portion, wherein said flange extends radially inward from said second end of said inner arcuate portion, wherein said inner arcuate portion extends axially within said outer shell from said inlet to said second end at said motor and defines a chamber configured to receive a secondary airflow from said inlet configured to cool said motor, wherein said motor is positioned within said cavity radially inward of said flow passage.

14. The air handling system in accordance with claim 13, wherein said flow passage extends circumferentially about said motor.

15. The air handling system in accordance with claim 13, wherein said fan comprises a plurality of blades extending from said curved plate into said flow passage.

16. The air handling system in accordance with claim 15, wherein said motor is coupled radially inward of said curved plate.

17. A method for assembling a blower assembly, said method comprising:

coupling an inner shell of a housing to an outer shell of the housing to define an inlet, an outlet, and a flow passage therebetween, wherein the inner shell at least partially defines a cavity;

coupling a fan within the outer shell such that the fan partially defines the cavity, wherein the fan includes a curved plate and an inner arcuate portion, the inner arcuate portion including a first end and a second opposed end, the first end coupled to the curved plate at the inlet; and coupling a motor to the inner shell, the motor including a rotor coupled directly to a flange of the inner arcuate portion of the fan such that the motor is positioned within the cavity radially inward of the flow passage, wherein the flange extends radially inward from the second end of the inner arcuate portion, wherein the motor is configured to rotate about an axis, and wherein the inner arcuate portion extends from the first end at the inlet to the second end at the motor and defines a chamber configured to receive a secondary airflow from the inlet configured to cool the motor.

18. The method in accordance with claim 17, wherein coupling the motor to the inner shell comprises coupling the motor axially between the fan and the inner shell.

19. The method in accordance with claim 17, wherein coupling the motor to the inner shell comprises coupling the motor such that the flow passage extends circumferentially around the motor.

20. The method in accordance with claim 17, wherein coupling the motor to the inner shell comprises coupling the motor such that the motor is isolated from said flow passage.

* * * * *